United States Patent [19]

Farrell et al.

[11] Patent Number: 4,964,447

[45] Date of Patent: Oct. 23, 1990

[54] FLAT DISK FLAKER

[75] Inventors: Eugene A. Farrell, Fishers Landing; Mark D. Robinson, Black River, both of N.Y.

[73] Assignee: Carthage Machine Company, Carthage, N.Y.

[21] Appl. No.: 437,589

[22] Filed: Nov. 17, 1989

[51] Int. Cl.[5] ..... B27C 1/00

[52] U.S. Cl. ..... 144/176; 144/162 R; 144/247 R; 144/369; 144/180; 241/92; 241/280

[58] Field of Search ..... 144/42, 162 R, 174, 144/176, 369; 241/92, 280, 281

[56] References Cited

U.S. PATENT DOCUMENTS

| | | | |
|---|---|---|---|
| 2,004,367 | 6/1935 | Brown . | |
| 2,617,454 | 11/1952 | Booth | 144/176 |
| 2,655,189 | 10/1953 | Clark | 144/42 |
| 2,796,094 | 6/1957 | Himmelheber et al. | 144/176 |
| 2,936,008 | 5/1960 | Brown . | |
| 3,237,663 | 3/1966 | Kirsten . | |
| 3,759,304 | 9/1973 | Lundmark et al. | 144/176 |
| 3,991,946 | 10/1976 | Berggren . | |
| 4,017,356 | 4/1977 | Bystedt . | |

*Primary Examiner*—W. Donald Bray
*Attorney, Agent, or Firm*—Wall and Roehrig

[57] ABSTRACT

A horizontal disk wood flaking machine has two or more continuous feed conveyors each of which has a vertical chute or feed box that brings wooden logs to an upper surface of the cutting disk. The drive motor for the disk is situated below the disk at the under side of the machine, so that the power train is from the bottom upwards.

7 Claims, 2 Drawing Sheets

FLAT DISK FLAKER

BACKGROUND OF THE INVENTION

This invention relates to rotary machines for reducing wood into wood flakes or strands suitable for the production of pressed wood particle board, headboard, or other kindred composite wood products. The rotary machines in question reduce logs directly into wood flakes or strands with the logs being previously debarked and cut to suitable lengths.

The present invention is more especially directed to a horizontal disk type flaker, which has an increased flake production capacity.

There are many flakers of various designs currently available, such as a drum-type flaker as described in U.S. Pat. No. 2,969,095, and a vertical disk-type flaker as described in U.S. Pat. No. 4,346,744.

In a vertical disk arrangement, the input feed for supplying logs to the disk cutting face has to be on the downturning side of the disk. Because of this, only a single feed can be associated with a given disk. Also, vertical disk flakers invariably employ a belt drive to connect the disk to the associated drive motor. Belt drives can accommodate only a limited amount of load. If a dual feed were installed on a vertical disk machine, the power requirements would become too large for the belt drive to handle.

A horizontal disk wood flaker of the type now employed has a vertical chute or hopper for feeding logs, that have been debarked and cut into suitable lengths, into contact with an upper cutting face of the horizontal rotary disk. Typically there is a vertical feed box on one side of the axis and a motor and drive transmission for the disk on the other side of the axis but also disposed above the disk. An area is left available for changing out knife blades on the cutting disk. These machines have a continuous conveyor system in which a horizontal conveyor brings the cut-to-length logs into the top of the vertical feed box where the logs form a stack that proceeds downwards into contact with the cutting face of the disk.

Although there is no "upturning" or "downturning" side of the horizontal disk, no one has previously considered adding a second feed box; this is partly because of the positioning of the motor drive on the top of the disk, and also partly because of the requirement to leave room for access the replacement of cutting blades. However, simply increasing the size of the vertical feed box to accommodate a greater capacity places a great, unbalanced radial load on the shaft of the disk and can cause wear on the bearings for the machine.

OBJECTS AND SUMMARY OF THE INVENTION

It is an object of this invention to provide a wood flaker machine which has approximately double the capacity of similar previous machines.

It is another object of the invention to provide a continuous feed horizontal disk flaker which maintains an even torsional loading during operation.

It is a further object of the invention to permit an increased production rate of wood flakes, wafers, or strands without increasing the number of flaker machines or the floor space required.

According to an aspect of this invention, a continuous feed horizontal disk wood flaker has a rotary cutting disk that is horizontally disposed and rotates about a vertical axis. On its upper surface are a number of generally radial elongated cutting blades or knives. Flake channels in the disk conduct the wood flakes from the blades to an underside of the disk. A shroud or cover is situated over the disk and includes a guide or flake conveyor beneath the disk to carry away the wood flakers (or strands or wafers) that are cut by the disk. The drive motor for the disk is situated below the disk, and has a ninety-degree drive transmission with a horizontal input shaft coupled to the motor and a vertical output shaft to turn the disk.

Above the disk are two (or more) continuous-feed conveyors for supplying two the upper side of the cutting disk logs that have been debarked and cut to a predetermined length. The logs are oriented so that they lay substantially along a radius of the disk. Each of the conveyors has a vertical feed chute or feed box that is open at its bottom through the shroud to bring the logs to the disk, and a conveyor to bring the logs into the chute or box such that the logs form a vertical stack in the chute with the logs at the bottom of the stack contacting the cutting disk.

By feeding the logs to two locations on the disk that are separated by equal angles of 180°, there is an even torsional load applied to the disk, and the flaking capacity of the disk is substantially doubled.

Because the motor and drive are situated below the disk, a second, and perhaps a third motor can be coupled to the drive transmission. This permits using a pair of five-hundred horsepower motor rather than a single one-thousand horsepower motor, so only a less expensive, smaller motor is needed.

The above and other objects, features, and advantages of this invention will become apparent to those of skill in the art from the ensuing description of a preferred embodiment, which is to be read in conjunction with the accompanying Drawing.

DETAILED DESCRIPTION OF THE PREFERRED EMBODIMENT

Figure 1:
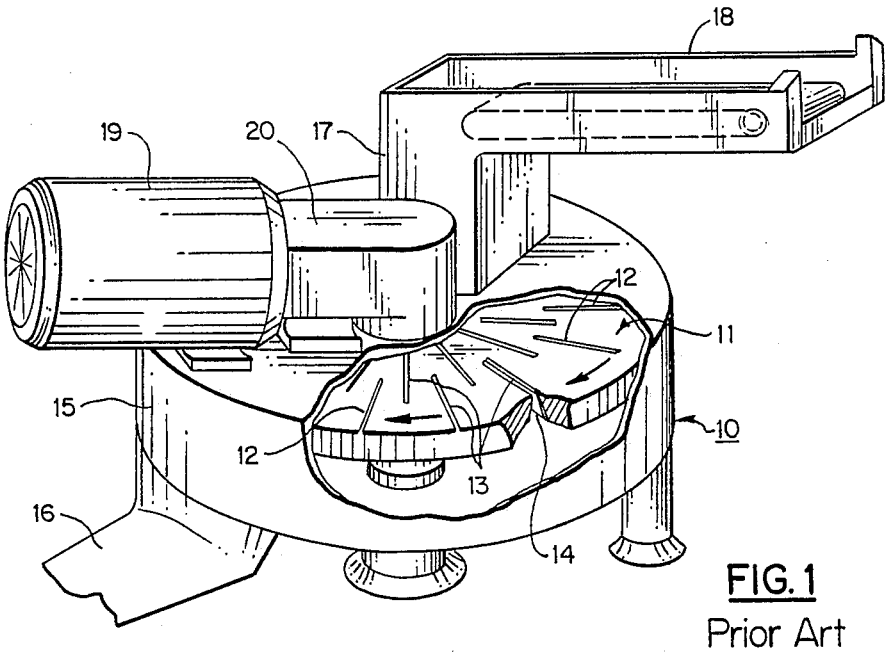
FIG. 1 Prior Art
FIG. 1 is a perspective view of a single feed horizontal disk flaker according to the prior art.

With reference to the drawing, FIG. 1 shows the salient features of a presently available single feed flaking machine 10 having a horizontally oriented disk 11. The disk has a number of cutting groups 12 on its upper surface, each of which comprises a radially oriented elongated blade 13 and a flake channel 14 which passes through the thickness of the disk to conduct wood flakes from the blade to the lower or under surface of the disk 11. A shroud or cover 15 is disposed over the disk, and here is shown partly cut away to illustrate the disk 11. A flake conveyor 16 or similar guide means is incorporated into the shroud beneath the disk 11 for conducting away the wood flakes to further processing machinery, not shown. A vertical supply chute 17 or box is situated on the machine 10 and extends vertically upwards through the shroud on one side of the axis of the disk 11. A generally horizontal conveyor 18 is connected with a top end of the chute 17 and boxing wooden logs or sticks, debarked and cut to length in a previous stage, into the chute or box 17. There they proceed downwards to form a stack within the chute 17 in which the logs are oriented to lie in the radial direction, i.e., parallel to the length of the blades 13 as they strike the logs. An electric motor 19, typically of about five-hundred horsepower, is disposed on the upper side of the flaking machine 10, where a drive assembly or transmission 20 couples the output shaft of the motor 19 to the disk 11 to drive the same. The logs at the bottom of the stack contact the rotating blades 13 and are reduced to flakes or strands.

Figure 2:
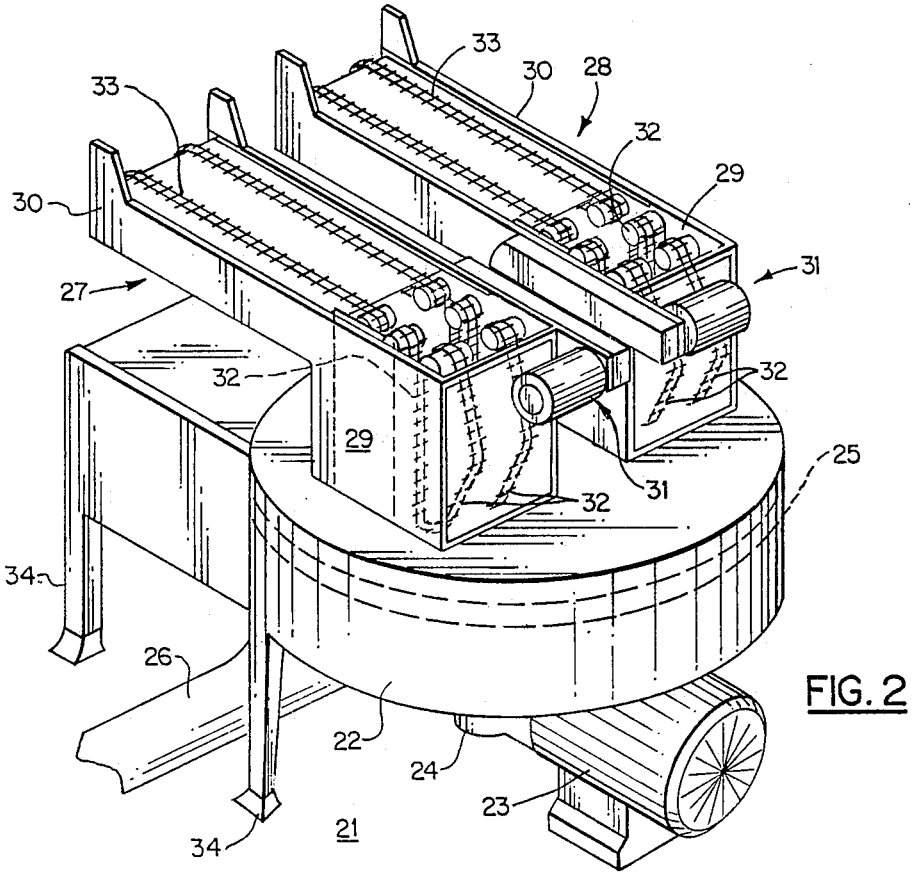
FIG. 2 is a perspective view of a dual feed horizontal disk flaker according to one embodiment of this invention.

A dual feed horizontal disk flaker 21 according to one embodiment of this invention is shown in FIG. 2. The principles of operation of disk flaker 21 are similar to those of the single feed flaking machine 10, except there are two identical vertical feed chutes or boxes, rather than the single feed box of the flaker 10, and the drive in this case is relocated to the underside of the machine, so that the power train extends upwards from below the disk.

In the flaker 21 of FIG. 2, a motor 23 and a drive 24 are situated beneath a shroud 22 which houses the flaking or cutting disk 25, shown in ghost. As in the previous embodiment, a flake output conveyor or discharge guide 26 carries the wood flakes, strands, or wafers to a subsequent processing device. The dual feed assembly is formed of a first continuous feed arrangement 27 and a second continuous feed arrangement 28. These are basically identical to one another, and are of the same general construction as the single feed arrangement shown in FIG. 1. Each of these feed arrangements 27 and 28 comprises a separate vertical chute 29 with a horizontal conveyor 30 which brings precut, debarked logs to its upper end. Each continuous feed arrangement has a separate drive mechanism 31 for powering a chain log feed vertical conveyor 32 which is inside the vertical chute 29 and a horizontal chain conveyor 33, which is inside the horizontal conveyor 30. As further shown in FIG. 2, and also shown in FIGS. 3 and 4, vertical supports 34 suspend the shroud 22 and other elements of the machine above the motor 23 and drive 24. An access door 35 (FIG. 4) is situated on one side of each of the vertical chutes 29, and is provided for purposes of inspection and maintenance. In this embodiment, the disk drive 24 is a ninety degree gear box with a horizontal input shaft that is coupled to the horizontally-oriented electric motor 23, and with vertical output shaft which drives the disk 25. As illustrated in ghost, a second input shaft can be provided on the drive 24 to which a second motor 36, also shown in ghost, can be connected.

Because of the increased load imposed on the disk, a much larger motor is required for this embodiment than for the single-feed flaker. That is, for the motor 23 a thousand horsepower is typically required, rather than five-hundred horsepower that is required with a conventional single-feed flaker. Good maintenance practice would require that a spare motor of the same size be kept on hand. However, motors of this size can be quite expensive. With the dual motor arrangement, i.e. employing both the motor 23 and the motor 36, both motors can be of the smaller i.e. five-hundred horsepower size, and it is necessary only to maintain a single spare five-hundred horsepower motor.

Figure 3:
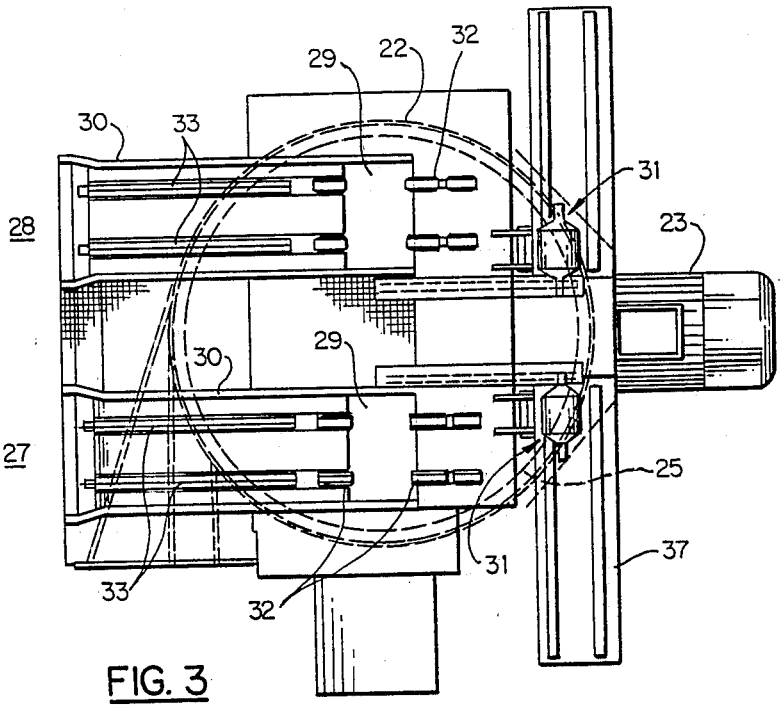
FIGS. 3 and 4 are a top plan view and a side elevation, respectively, of the horizontal disk flaker of the embodiment of FIG. 2.
Figure 4:
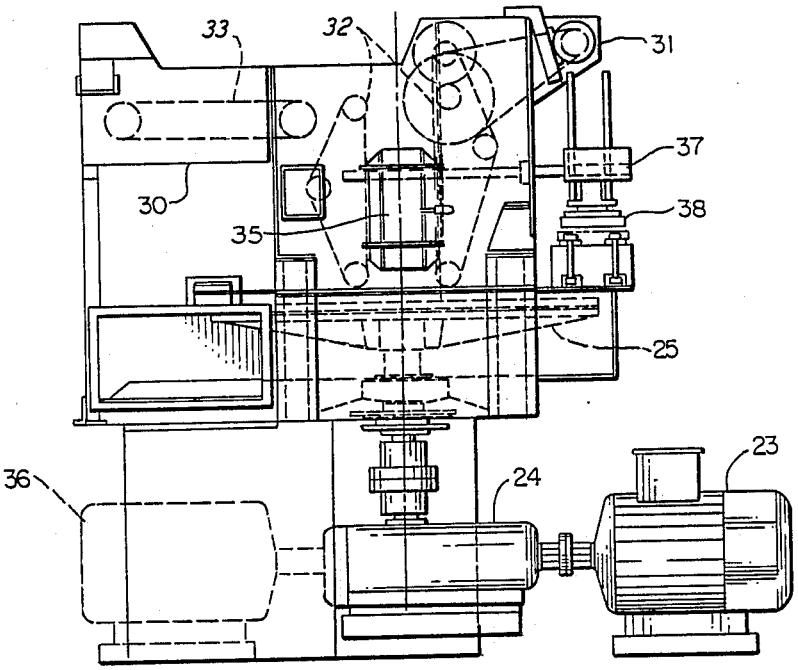

As also shown in FIGS. 3 and 4, a horizontal conveyor 37 and a magnetic lift device 38 can be provided, for changing out the knife blades 13 and bringing any other heavy items or equipment to or from the upper surface of the disk.

While in this embodiment there are two continuous feed arrangements 27 and 28, three or more continuous feed devices could be employed. In each case, the respective vertical chutes 29 should orient the logs radially with respect to the disk. The three or more chutes 29 should be disposed evenly about the disk, e.g , at 120° intervals in the triple-feed arrangement, so that a radially balanced load is imposed on the disk. In the illustrated embodiment, the continuous feed arrangement 27 and 28 are situated with their vertical chutes 29 disposed 180° apart, and with the horizontal conveyors 30 extending in parallel and to one side of the machine.

While the invention has been described in detail with respect to a preferred embodiment, it should be understood that the invention is not limited to that precise embodiment. Rather, many modifications and variations would present themselves to those skilled in the art without departing from the scope and spirit of this invention, as defined in the appended claims.

What is claimed is:

1. A horizontal disk multiple continuous feed wood flaker comprising:

a. a rotary cutting disk that is horizontally disposed with a vertical axis and having on an upper surface a plurality of radially oriented cutting groups each with an elongated flaker knife and a flake channel for conducting wood flakes from the associated knife to an under surface of the disk;

b. a shroud disposed over said disk including guide means beneath the disk to conduct away wood flakes produced by said cutting disk;

c. a drive motor for said disk mounted beneath said disk and an associated drive connecting the motor to the vertical axis of said disk; and d. at least a pair of continuous feed conveyors for supplying logs previously cut to a predetermined length to the upper side of said cutting disk with the logs being oriented generally along a radius of the disk, each of the continuous feed conveyors having a vertical feed chute that is open at its bottom through said shroud and a conveyor for bringing the logs in the proper orientation into a top of said chute, such that the logs form a vertical stack in said chute with the logs at the bottom of the stack contacting said cutting disk.

2. A horizontal disk multiple continuous feed wood flaker according to claim 1, wherein the respective vertical feed chutes are distributed evenly about the disk so that a radially balanced load is imposed on the disk.

3. A horizontal disk multiple continuous feed wood flaker according to claim 2 wherein there are two or more continuous feed conveyors with their respective chutes oriented substantially symmetrically.

4. A horizontal disk multiple continuous feed wood flaker according to claim 2, wherein there are two of said continuous feed conveyors, with their respective vertical feed chutes oriented 180° apart.

5. A horizontal disk multiple continuous feed wood flaker according to claim 4, wherein the associated conveyors for said vertical feed chutes are oriented parallel to one another and extend to one side of the flaker.

6. A horizontal disk multiple continuous feed wood flaker according to claim 1, wherein said drive connecting the motor to the disk is a 90-degree gear transmission with a horizontal input coupled to said motor and a vertical output connected to said disk.

7. A horizontal disk multiple continuous feed wood flaker according to claim 6, wherein said 90-degree gear transmission has a second input to which a second drive motor can be connected.

* * * * *